US010561180B2

(12) United States Patent
Squires

(10) Patent No.: US 10,561,180 B2
(45) Date of Patent: Feb. 18, 2020

(54) SYSTEM FOR RAPID APPLICATION AND ADJUSTMENT OF PROTECTIVE CUSHIONING

(71) Applicant: The Boeing Company, Chicago, IL (US)

(72) Inventor: Lile P. Squires, Mukilteo, WA (US)

(73) Assignee: The Boeing Company, Chicago, IL (US)

( * ) Notice: Subject to any disclaimer, the term of this patent is extended or adjusted under 35 U.S.C. 154(b) by 33 days.

(21) Appl. No.: 15/148,138

(22) Filed: May 6, 2016

(65) Prior Publication Data

US 2017/0318871 A1 Nov. 9, 2017

(51) Int. Cl.
*A41D 13/05* (2006.01)

(52) U.S. Cl.
CPC ..... *A41D 13/0562* (2013.01); *A41D 13/0543* (2013.01)

(58) Field of Classification Search
CPC . A41D 13/0543; A41D 13/0562; A41D 13/08
USPC ..... 2/455, 16, 22, 23
See application file for complete search history.

(56) References Cited

U.S. PATENT DOCUMENTS

| | | | | |
|---|---|---|---|---|
| 7,380,283 | B1 * | 6/2008 | Dumont | A41D 13/0562 2/23 |
| 2009/0151039 | A1 * | 6/2009 | Kielland | A41D 13/065 2/24 |
| 2011/0307998 | A1 * | 12/2011 | Turner | A41D 13/05 2/455 |
| 2012/0198606 | A1 * | 8/2012 | Bowden | A41D 13/0512 2/462 |
| 2012/0227150 | A1 * | 9/2012 | Brown | A41D 13/0153 2/24 |
| 2014/0033412 | A1 * | 2/2014 | Sizemore | A41D 13/065 2/455 |

* cited by examiner

*Primary Examiner* — Katherine M Moran
(74) *Attorney, Agent, or Firm* — Felix L. Fischer

(57) ABSTRACT

A system for rapid application and adjustment of protective cushioning employs a garment component covering a body portion and having a securing element affixed thereto. A pad having a mating securing element affixed thereto is releasably attachable to the securing element to engage the pad to the garment component to protect the body portion.

20 Claims, 14 Drawing Sheets

SYSTEM FOR RAPID APPLICATION AND ADJUSTMENT OF PROTECTIVE CUSHIONING

BACKGROUND INFORMATION

Field

Embodiments of the disclosure relate generally to devices for padding the arms or legs of a worker for protection and comfort while working and more particularly to a padding system having a securing element affixed to the workers clothing and a mating securing element affixed to a shaped pad for removable attachment to the clothing securing element.

Background

Workers, in particularly mechanics working on large aircraft assemblies, often require padding to comfortably kneel or recline while working on the structure being assembled. Conventional knee pads or elbow pads which employ straps to wrap around the mechanic's knees, legs, elbows or arms are often cumbersome particularly when standing or walking to move from place to place on the structure and difficult to remove to allow free movement. Additionally, the surface of the structure being worked on may have particular features or profiles on which conventional padding may not be effective. Previous solutions for allowing workers to lean across and traverse uneven surfaces (e.g., stringer systems in aircraft structural paneling) utilized large-thick blankets lying on top of the uneven surfaces. Due to size or cumbersome requirements for arrangement on the surface, the blanket solution may sometimes allow or create damage to the underlying structure. The traditional knee pads do not enable to worker to easily traverse the uneven surface and typically they only protect the knee or elbow. Traditional knee pads may also damage the underlying structure since the padding depth is typically minimal. Furthermore, because traditional knee pads are secured to the worker in such a manner that prohibits easy removal, a worker may be injured by the pad if the pad is accidently snagged by the underlying structure or any other moving part.

It is therefore desirable to provide a padding system which is modular and easily removable including a "tear away" capability in the event of catching or snagging of the pad on the structure.

SUMMARY

Embodiments disclosed herein provide a system for rapid application and adjustment of protective cushioning having a garment component covering a body portion and having a securing element affixed thereto. A pad having a mating securing element affixed thereto is releasably attachable to the securing element to engage the pad to the garment component to protect the body portion.

The disclosed embodiments provide a method for operation of a system for rapid application and adjustment of protective cushioning accomplished by affixing a securing element to a garment component adjacent a body part to be padded and affixing a mating securing element to a mating surface of a pad. The pad is then releasably attached to the garment component by engaging the mating securing element on the pad to the securing element on the garment component.

The features, functions, and advantages that have been discussed can be achieved independently in various embodiments of the present disclosure or may be combined in yet other embodiments, further details of which can be seen with reference to the following description and drawings.

DETAILED DESCRIPTION

Embodiments disclosed herein provide cushioning pads coupled with a securing element to a portion of a workers clothing having a mating securing element. The cushioning pads may be any type of relatively soft padding, for example, polyurethane foam. The securing element and mating securing element may be any type of material having cooperative releasable securing ability, for example, hook and loop fastening systems (Velcro®). A worker can attach the mating hook or loop element to his pant legs or sleeves using strips having an adhesive backing or the clothing, such as coveralls, may have the strips sewn on. The adhesive sticks to the clothing and the hook or loop side is secured to the hook or loop securing element attached to the pads. The hook or loop element may be attached to the pads using adhesive backing or may otherwise be adhesively or mechanically secured to the pad or the pad may have a fabric covering to which the element is sewn.

Figure 1A:
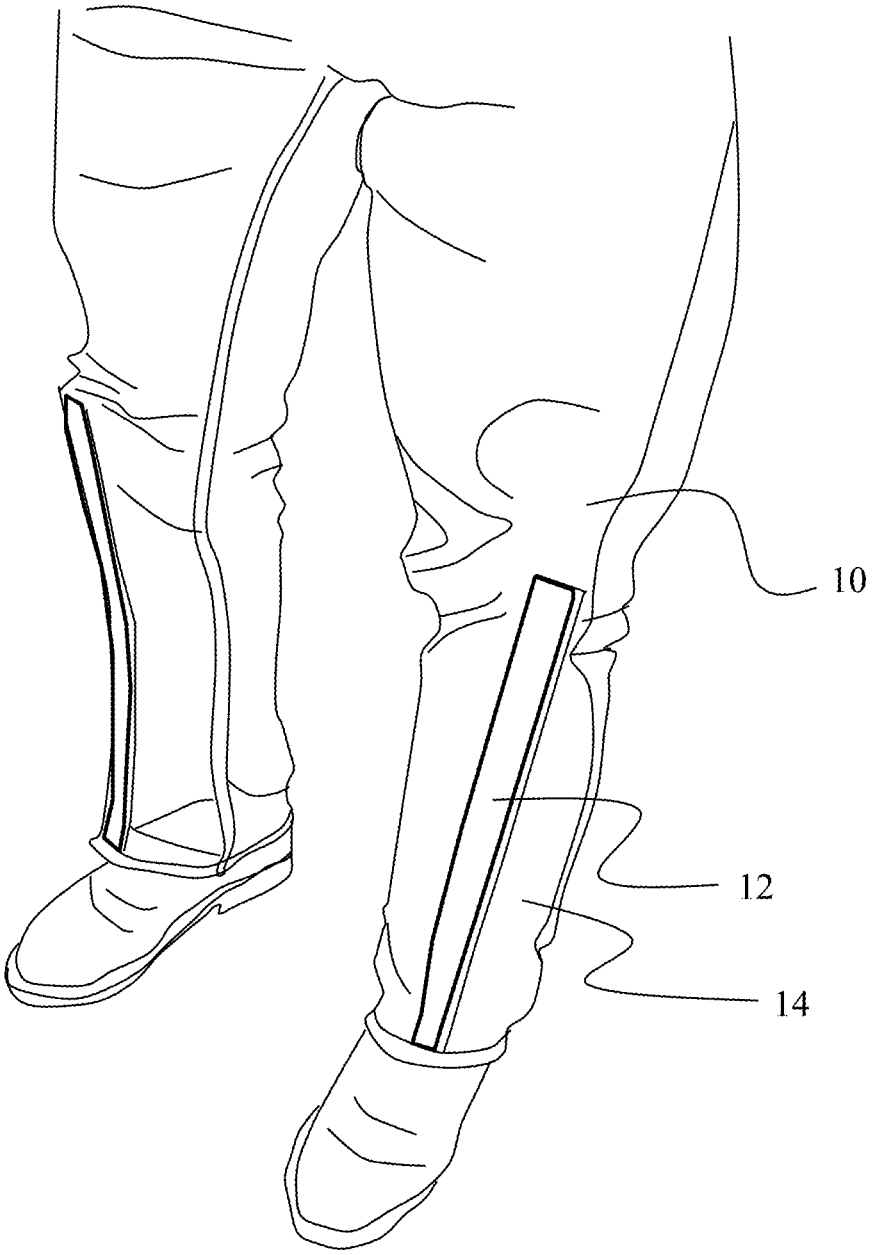
FIG. 1A is a pictorial representation of an embodiment of an exemplary securing element for the padding system affixed to the lower leg portion of a mechanic's apparel.

Referring to the drawings, FIG. 1A shows exemplary pant legs 10 as a garment component having a securing element 12 affixed to an anterior surface of a shin segment 14 of each pant leg. For the embodiment shown, the securing element is a strip of loop portion of a hook and loop fastener. The strip of loop portion is adhesively backed and applied to the pant leg by stripping a protective cover from the adhesive and adhering the strip to the shin segment of the pant leg. In alternative embodiments, the strip may be sewn to the pant leg.

Figure 2A:
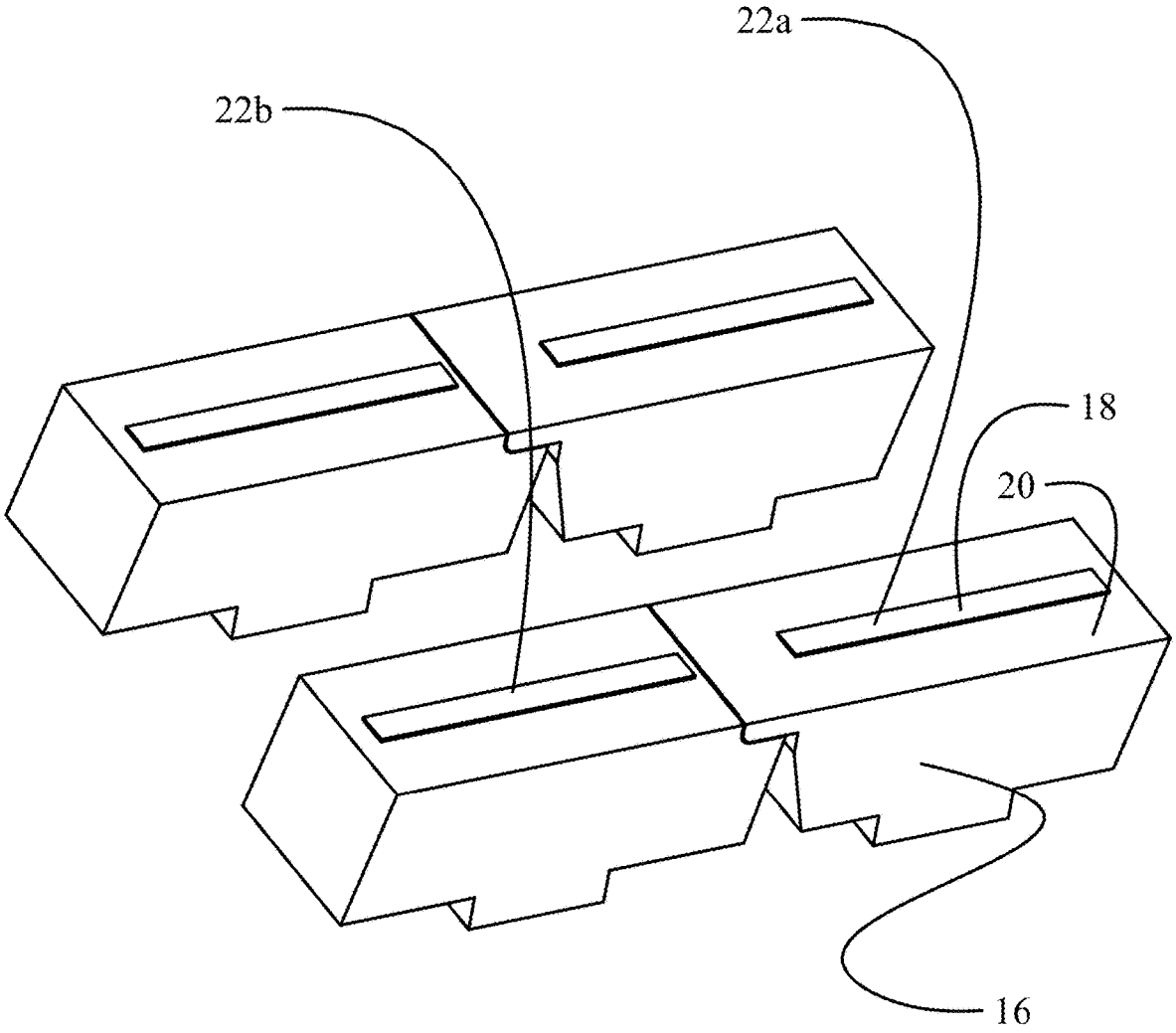
FIG. 2A is a pictorial representation of contoured padding having a mating securing element to be removably attached to the securing element on the lower leg portion of FIG. 1A.

FIG. 2A shows an exemplary pad set 16 having a releasable mating securing element 18 affixed to a posterior surface 20 of the pad set. For the exemplary pad set the mating securing element is a strip of hook portion of the hook and loop fastener. As with the loop portion of the fastener, the strip of hook portion is adhesively backed and applied to the posterior surface of the pad set by stripping a protective cover from the adhesive and adhering the strip to the surface. In alternative embodiments, the strip may be sewn to a fabric covering of the pad set or mechanically attached to the pad set using clips, rivets or similar fasteners. For the embodiment in the drawing, the mating securing element is split into two serially aligned portions 22*a*, 22*b* to accommodate functionality of the pad set as will be described in greater detail subsequently.

Figure 3A:
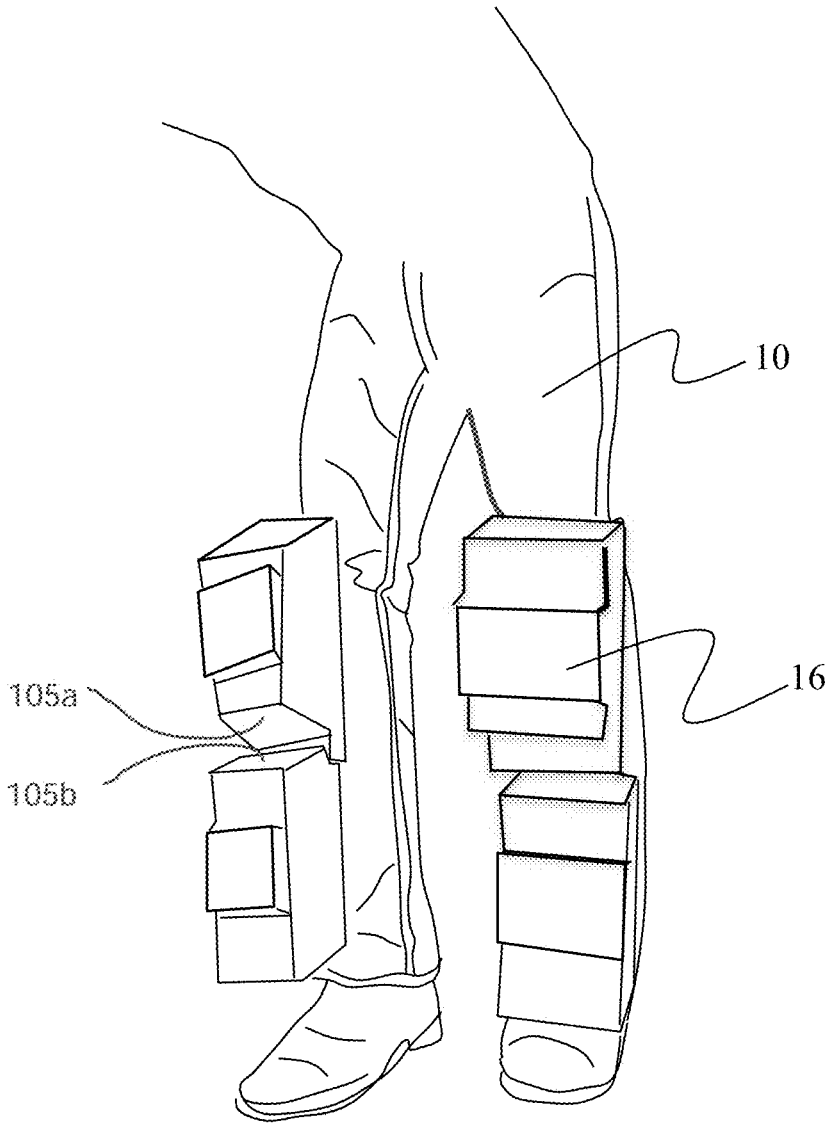
FIG. 3A shows the contoured padding of FIG. 2A attached to the lower leg portion of the mechanics apparel of FIG. 1A by engaging the securing elements and mating securing elements.

The pad set 16 is matingly attached to the pant legs 10 as shown in FIG. 3A by aligning and engaging the securing element 12, the loop portion, and releasable mating securing element 18, the hook portion. The pad set 16 is easily attached and removed, as desired by engaging or disengaging the hook and loop fasteners comprising the securing element and mating securing element. The releasable nature of the hook and loop fasteners provides the desired safety feature of having the pad set capable of "tear away" action from the pant leg if the pads should become caught on the work surface. Having the pad set attached to the clothing portions of, for example, work coveralls, eliminates the typical discomfort and frustration with existing knee pad deigns. Blood circulation is not restricted in lower leg since no "pinch point" created by attachment bands is present. No elastic/straps avoids pulling leg hair and lack of bunching of clothing under the straps which may cause sweating, bunching and discomfort. Changing position from kneeling to standing does not cause the knee pad to slip down the leg thereby avoiding the requirement of uncomfortably tight straps.

Figure 1B:
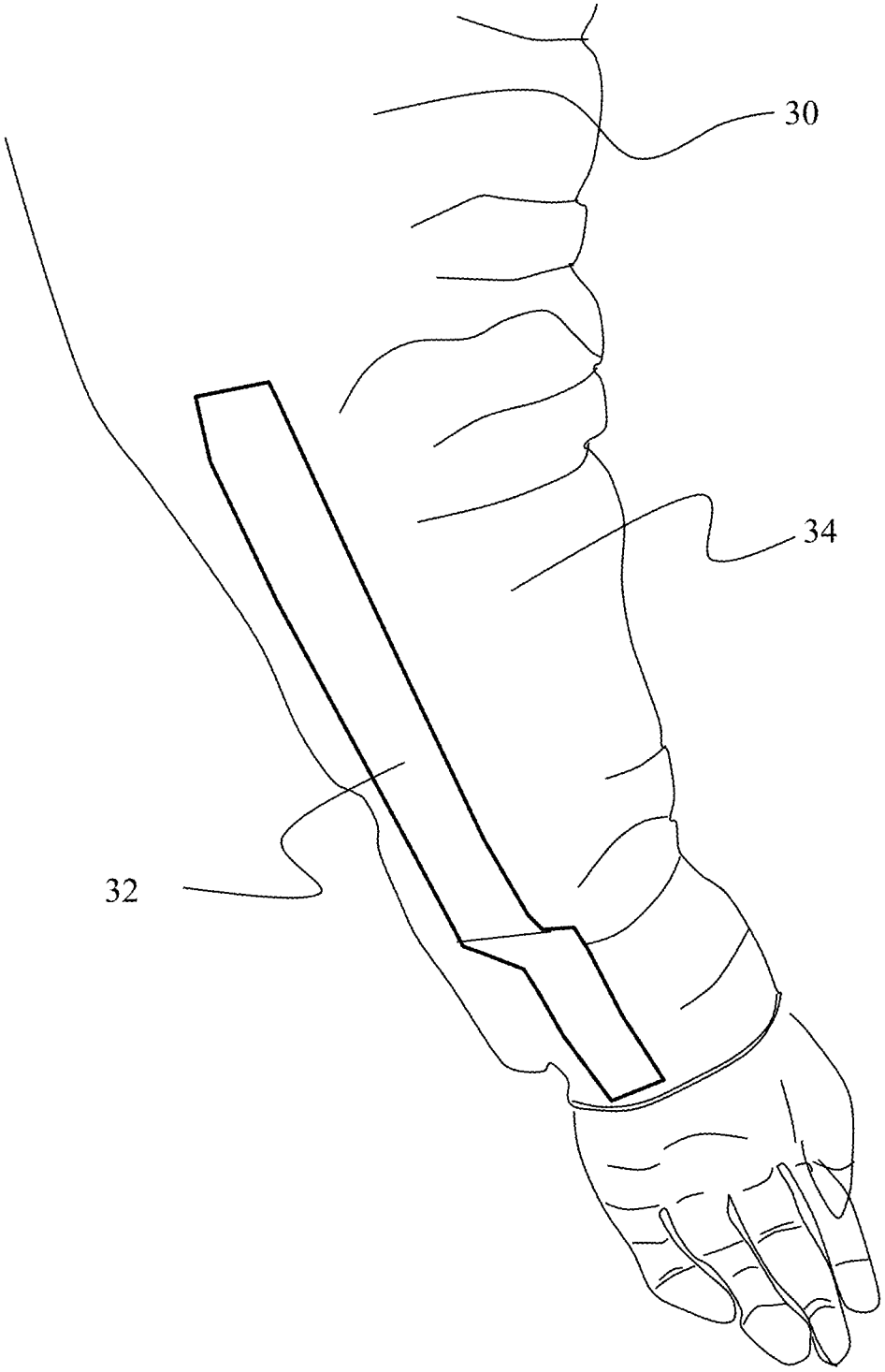
FIG. 1B is a pictorial representation of an embodiment of an exemplary securing element for the padding system affixed to the lower arm portion of a mechanic's apparel.

FIG. 1B shows an exemplary attachment to an alternate body portion, the forearm, wherein sleeve 30 has a securing element 32 affixed to posterior surface of a forearm portion 34 from the elbow to the wrist. As in the previously described example for the pant legs, the securing element is a strip of loop portion of a hook and loop fastener. The strip of loop portion is adhesively backed and applied to the sleeve by stripping a protective cover from the adhesive and adhering the strip to the forearm segment of the sleeve. In alternative embodiments, the strip may be sewn to the sleeve.

Figure 2B:
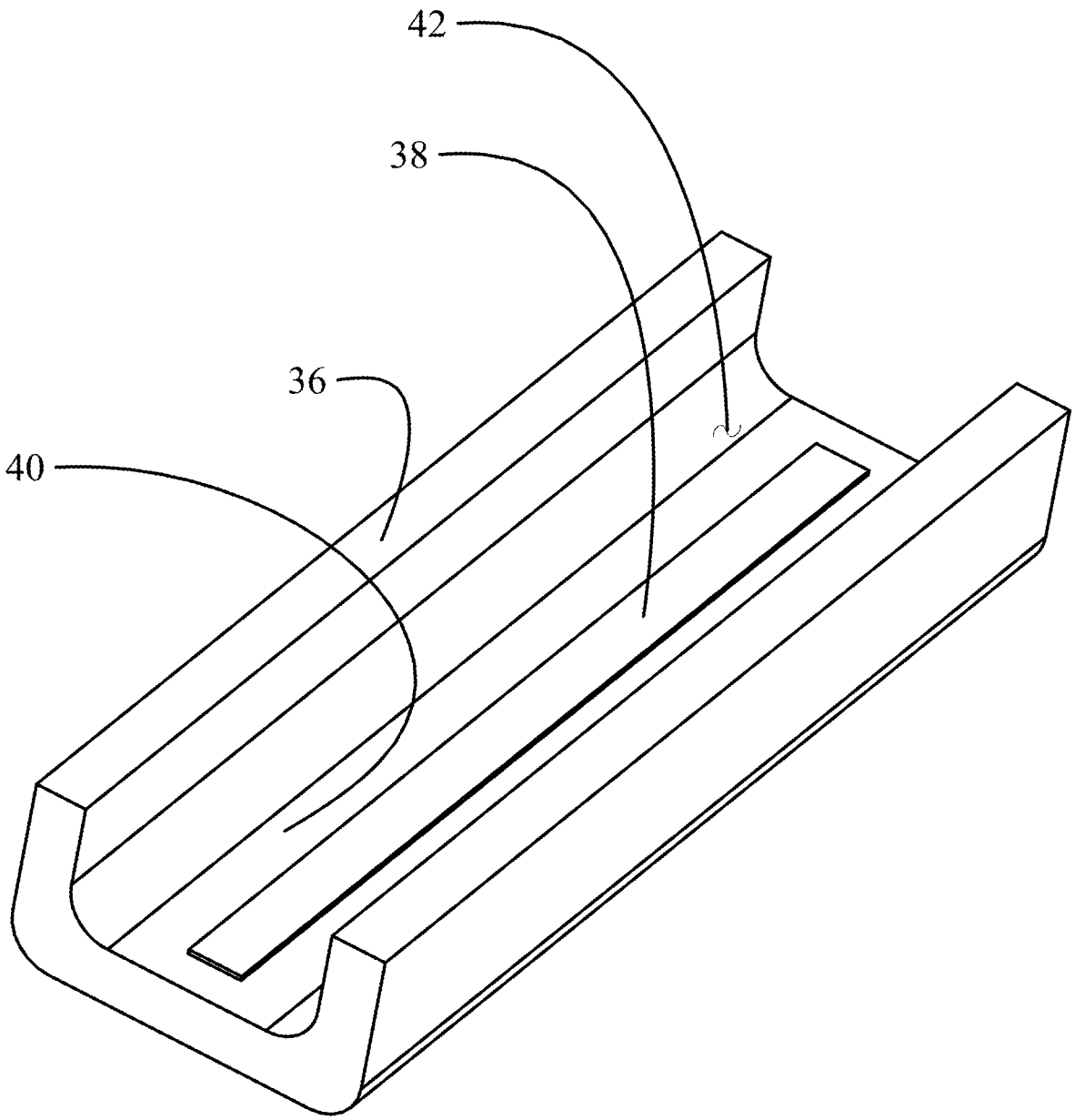
FIG. 2B is a pictorial representation of a contoured pad having a mating securing element to be removably attached to the securing element on the lower arm portion of FIG. 1B.

FIG. 2B shows an exemplary pad 36 having a releasable mating securing element 38 affixed to an anterior surface 40 of the pad. For the exemplary pad the mating securing element is a strip of hook portion of the hook and loop fastener. As with the loop portion of the fastener, the strip of hook portion is adhesively backed and applied to the anterior surface of the pad set by stripping a protective cover from the adhesive and adhering the strip to the surface. In alternative embodiments, the strip may be sewn to a fabric covering of the pad or mechanically attached to the pad using rivets or similar fasteners, as will be described subsequently. For the example shown, the pad 36 incorporates a formed or machined contoured anterior surface providing a cavity 42 into which an arm in the sleeve 30 is received allowing the pad to partially surround the arm enhancing engagement of the body part with the pad.

Figure 3B:
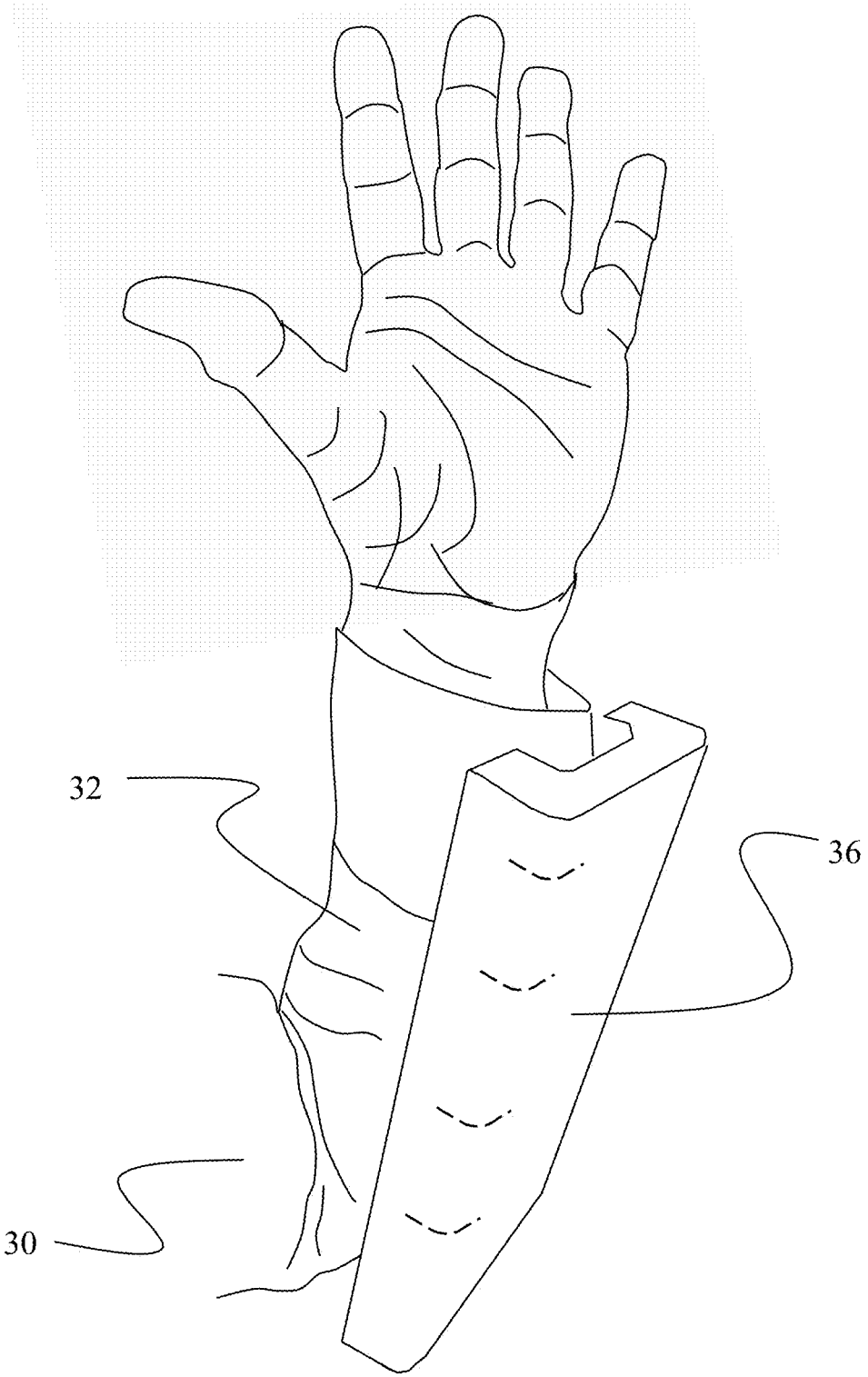
FIG. 3B shows the contoured pad of FIG. 2B attached to the lower arm portion of the mechanic's apparel of FIG. 1B by engaging the securing elements and mating securing elements.

The pad 36 is matingly attached to the sleeve 30 as shown in FIG. 3B by aligning and engaging the securing element 32, the loop portion, and releasable mating securing element 38, the hook portion. The pad 36 is easily attached and removed, as desired by engaging or disengaging the hook and loop fasteners comprising the securing element and mating securing element. As with the previously described pant leg example, the releasable nature of the hook and loop fasteners provides the desired safety feature of having the pad capable of "tear away" action from the sleeve if the pad should become caught on the work surface.

While the alternate body portion is exemplified in the previous description as a sleeve/arm, torso sides, back, buttocks, hips, knees, thighs, chest, upper arm and collar/neck may also be protected with similar pad arrangements engaged with a mating securing element to a securing element affixed to the covering clothing portion.

Figure 4A:
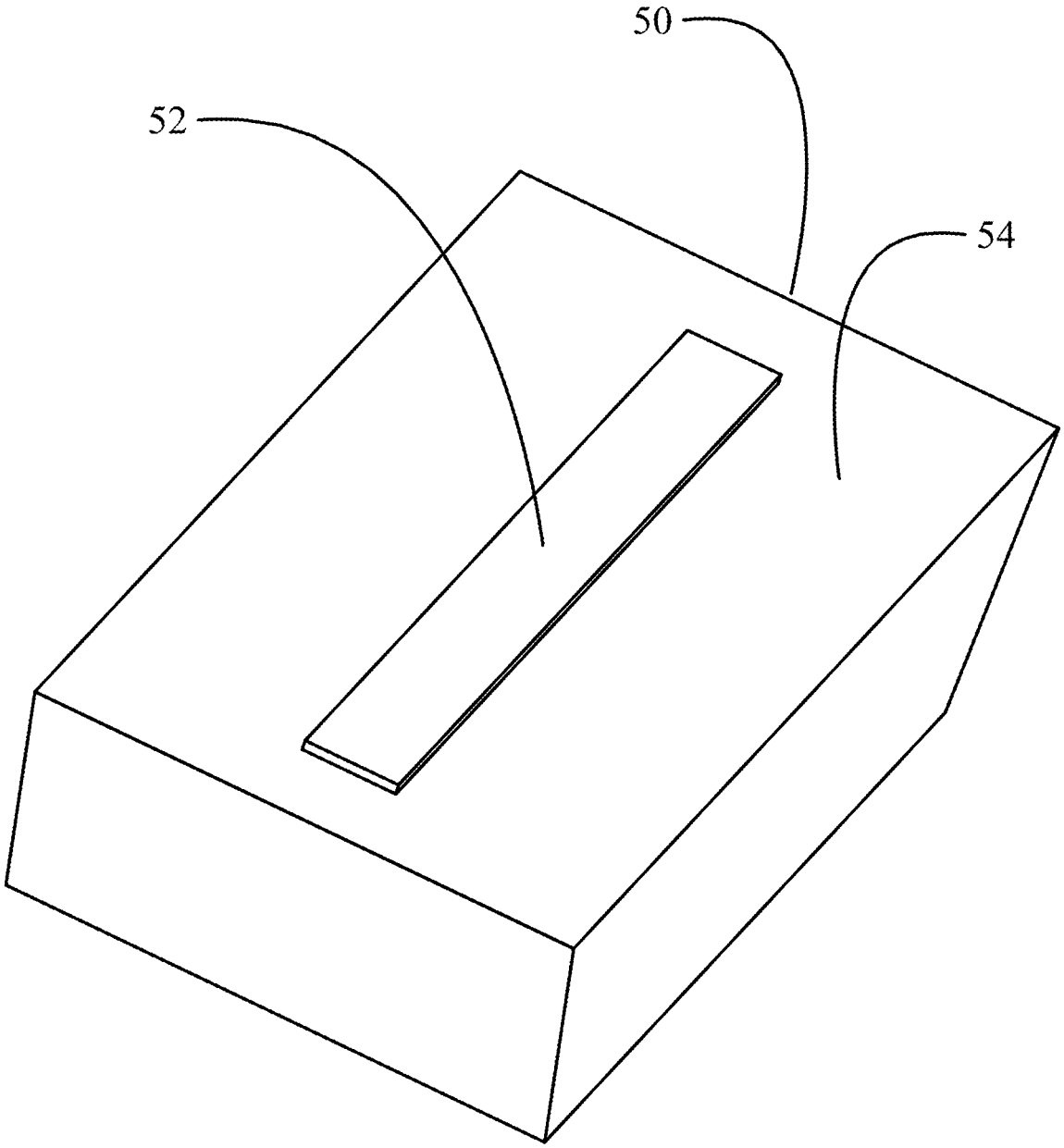
FIG. 4A is a representation of a first exemplary pad configuration.

The shape and size of the pad or pads as well as location, size and number of securing elements may be adapted to more closely receive the associated body part and to enhance the ability of the pad to be maintained in proper position on the body part. FIG. 4A shows a basic implementation with a pad 50 with a rectangular block shape having a single mating securing element 52 affixed to a mating surface 54. A single strip securing element having a nominal single strip width of 1.0 to 1.5 inches is shown for the exemplary embodiment. The mating securing element would be adapted to engage a securing element on, for example, a shin portion of a pant leg as described with respect to FIG. 1A.

Figure 4B:
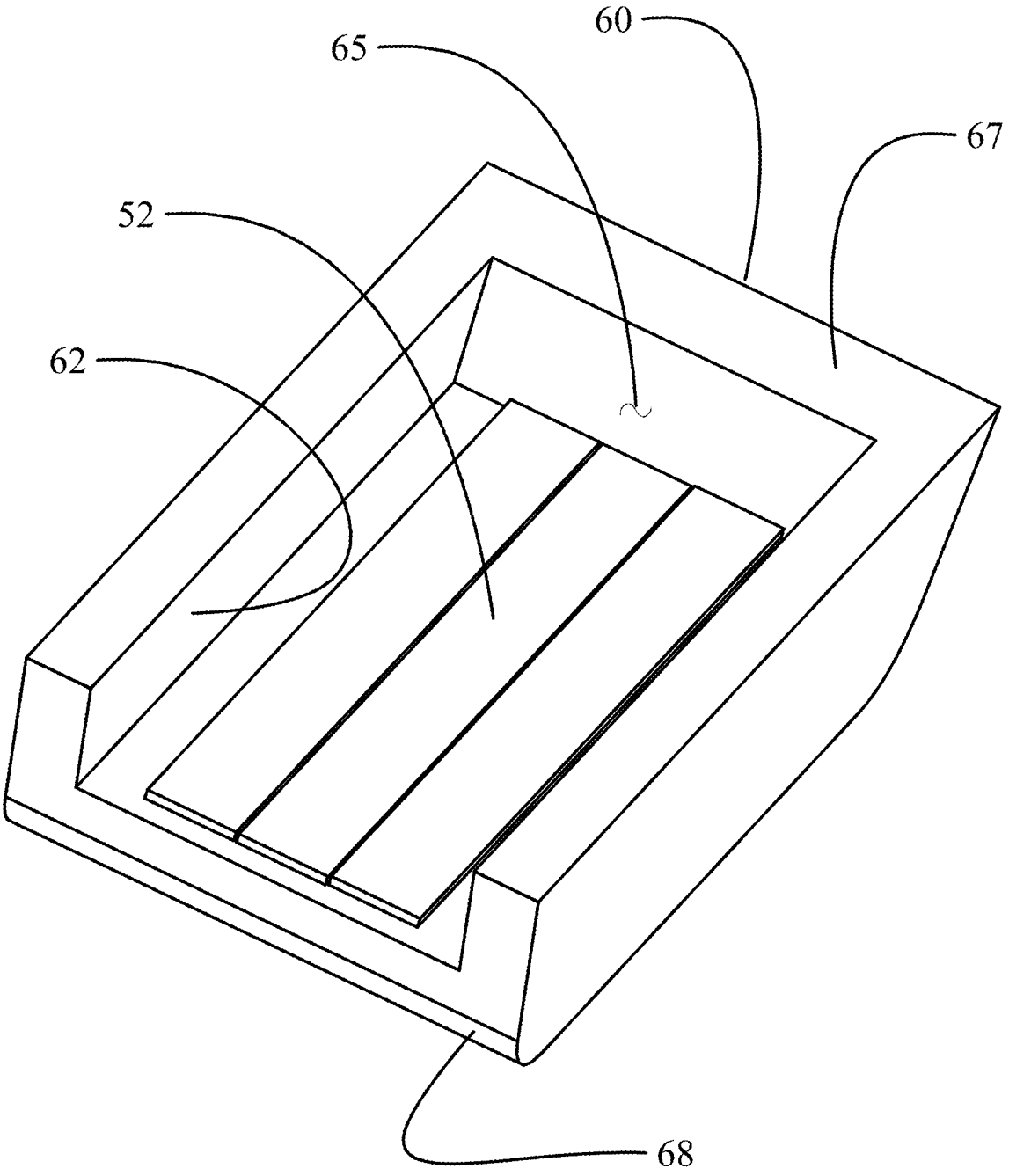
FIG. 4B is a representation of a second exemplary pad configuration.

FIG. 4B shows an enhanced pad implementation wherein a pad 60 has an interior sculpted surface 62 on which a mating securing element 64 is affixed. A cavity 65 is created by the sculpted surface 62 to receive the associated body part, the shin as an example. A port 66 is present in a lower end of the sculpted surface to allow the ankle to protrude while a wall 67 is present at an upper end of the sculpted surface to surround the knee in the kneeling position. An exterior surface 68 may have rounded contours at each end to allow rocking motion of the pad as the mechanic moves on the work surface. The mating securing element 64 has an extended width of three to four times the nominal single strip width to allow greater adherence to a securing element on the shin portion of the pant leg having a similar extended width. The extended width may be achieved by parallel placement of multiple strips of nominal single strip width or a single extended width strip.

Figure 4C:
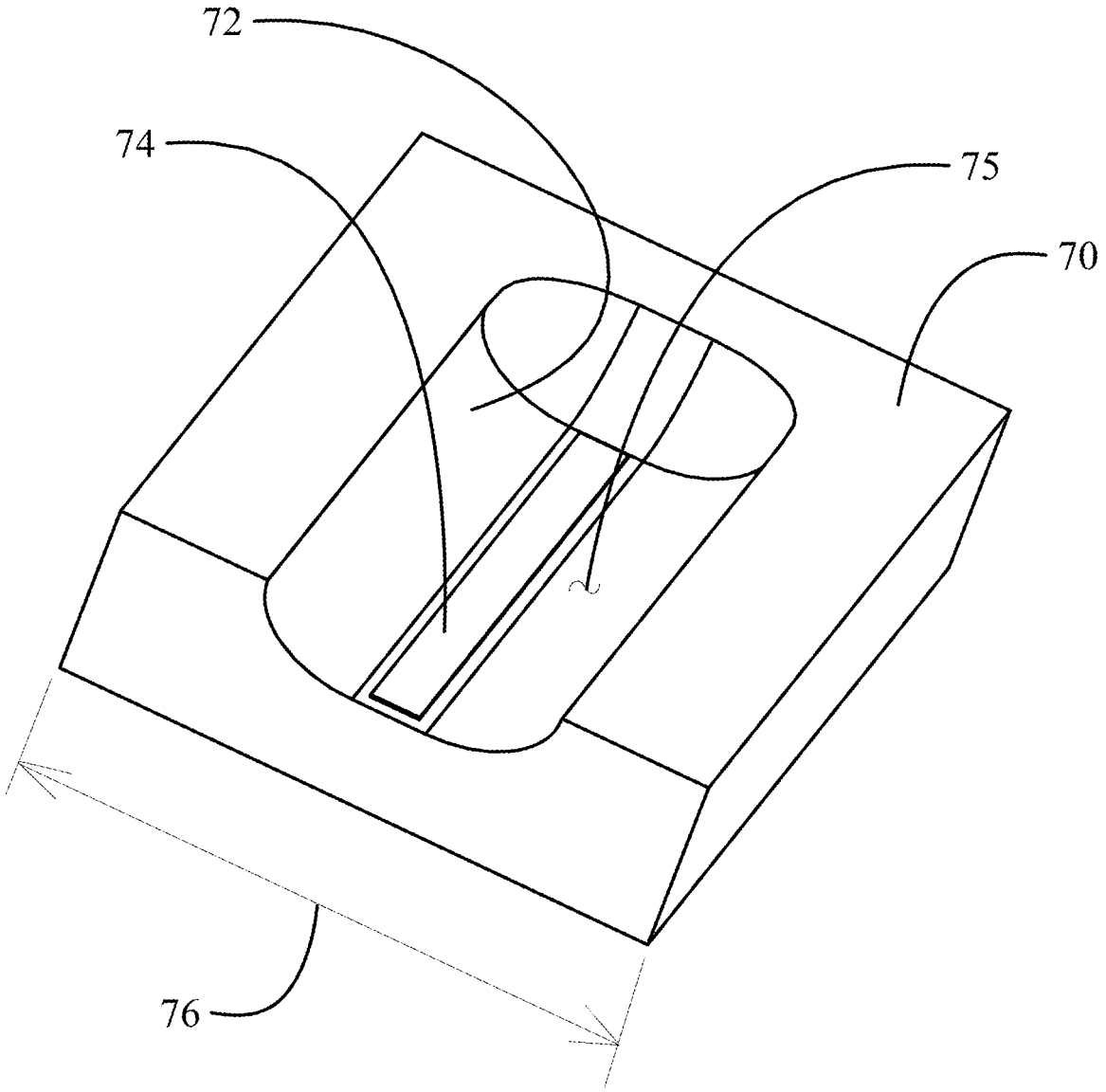
FIG. 4C is a representation of a third exemplary pad configuration.

FIG. 4C shows an alternative enhancement for a pad 70 having a sculpted mating surface 72 with an affixed mating securing element 74 and associated cavity 75. The pad 70 has an extended width 76 to increase the footprint of the pad on the work surface. As in the embodiment of FIG. 4A a single strip of nominal width is employed as the mating securing element.

Figure 4D:
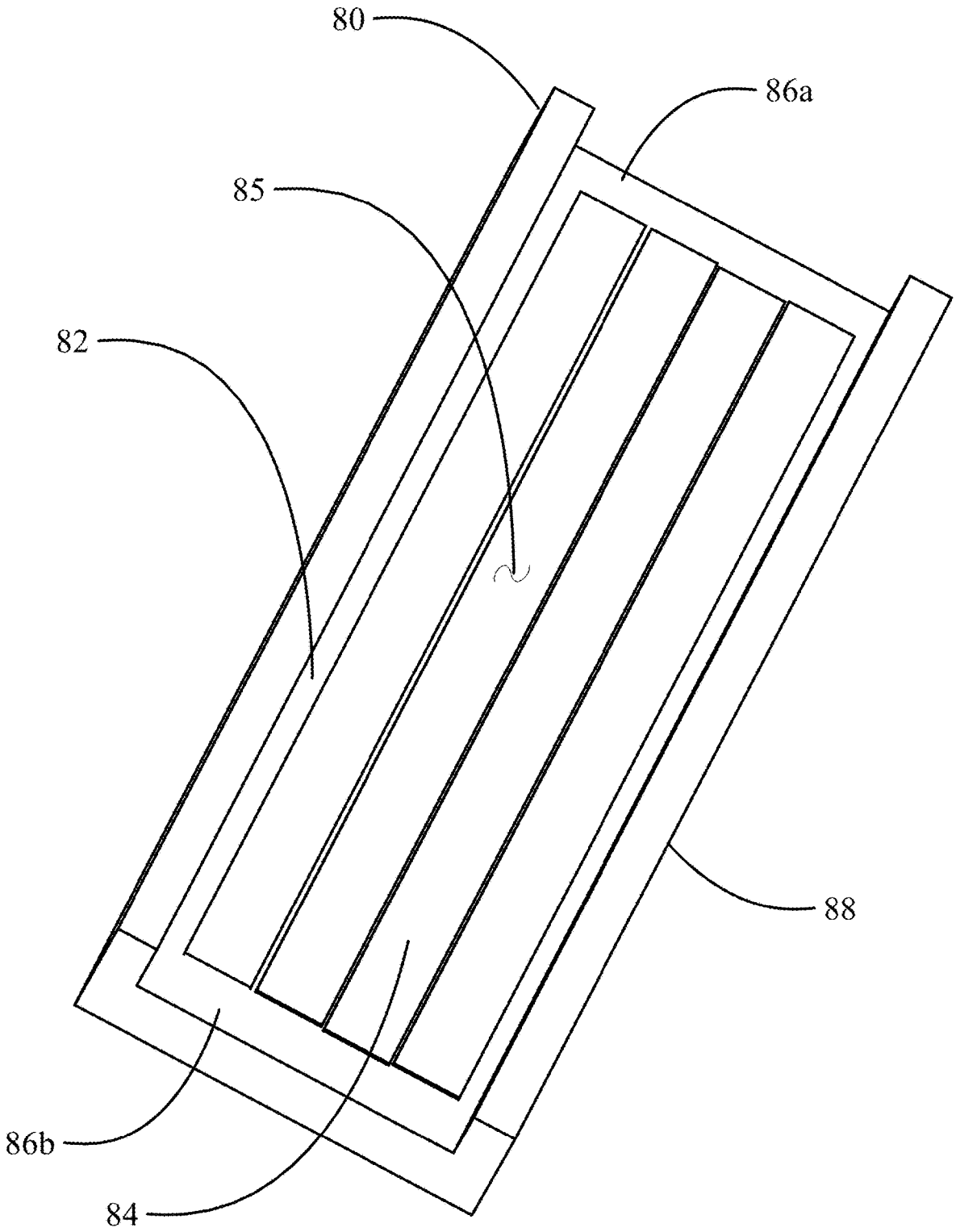
FIG. 4D is a representation of a fourth exemplary pad configuration.

FIG. 4D shows a pad 80 having configuration highly suitable in differing sizes for use on the forearm or sides of the torso. A sculpted interior surface 82 is provided on which a mating securing element 84 is affixed. A cavity 85 is created by the sculpted surface 82 to receive the associated body part, a forearm or torso side as examples. Port 86*a* and 86*b* are present in both ends of the sculpted surface to allow the wrist and elbow to protrude in a forearm application or to allow the upper extremity of the side approaching the underarm and the lower side approaching the hip to smoothly protrude. An exterior surface 88 may have a rounded longitudinal contour to allow lateral rocking motion of the pad as the mechanic moves on the work surface. The mating securing element 84 has an extended width of three to four times the nominal single strip width to allow greater adherence to a securing element on the forearm portion of the sleeve or side of the shirt or coverall torso having a similar extended width. The extended width may be achieved by parallel placement of multiple strips of nominal single strip width or a single extended width strip.

Figure 4E:
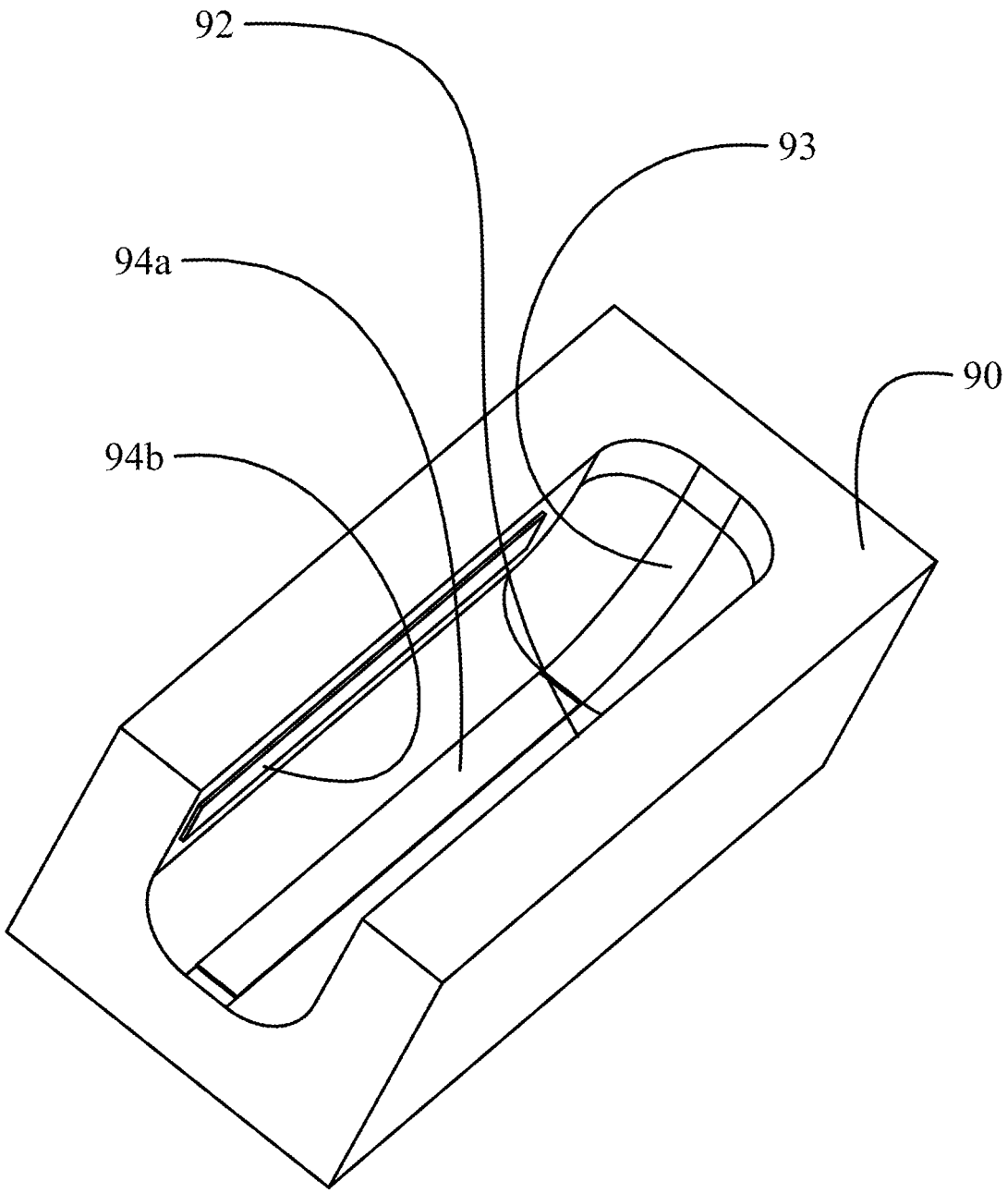
FIG. 4E is a representation of a fifth exemplary pad configuration.

Additional stability of the pad attachment to the work garment can be achieved as shown in FIG. 4E wherein the pad 90 has a deeply contoured sculpted surface 92 to receive, for example, the shin. Multiple mating securing elements are provided with a bottom element 94*a* to engage a securing element on the anterior portion of the lower pant leg on the shin and at least one side element 94*b* to engage medial and/or lateral surfaces of the lower pant leg. The bottom and side elements may be nominal width single strips with securing element strips affixed, for example, to the lower pant leg at appropriate locations on the anterior, medial and lateral surface of the lower pant leg material. This configuration minimizes rotation of the pad on the leg. The contoured sculpted surface 92 may extend around a semispherical end 93 to engage the knee and the mating securing element 94*a* may extend on the semispherical end with a securing element extending over the knee of the pant leg.

Figure 4F:
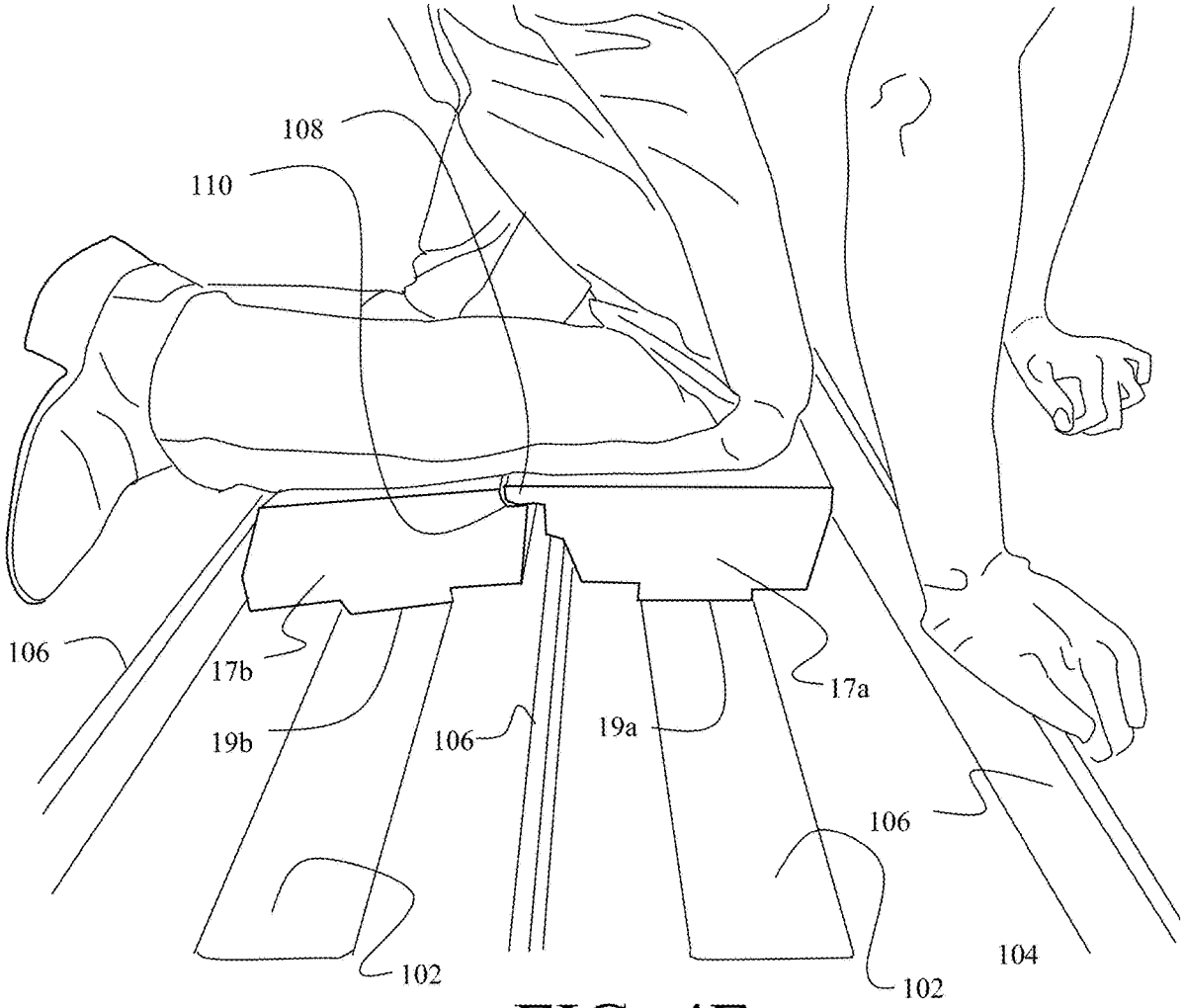
FIG. 4F is a pictorial view of a contoured pad configuration engaged with a work surface.

As previously discussed, the outer surface of the pad which engages the work surface may also be shaped with a profile to optimize engagement between the pad and work surface. As seen in FIG. 4F, a pad set 16 as described with respect to FIGS. 1A, 2A and 3A may be affixed to the shin portion of the pant leg. The separate pads 17*a* and 17*b* of the pad set 16 have lower surfaces 19*a* and 19*b*, respectively, which are contoured to be received in skin dimples 102 in the work surface 104. The joining surfaces 105*a*, 105*b* of the pads are contoured to receive spaced stringers 106 extending from the work surface 104. Pad 17*a* may include a tab 108 received in a relief 110 in pad 17*b* to interengage the pads. Alternatively, the pad set may employ a single pad with the bottom surface contoured to receive the stringer. The mechanic may comfortably kneel on the work surface with the pad set accommodating the various repetitive surface features of the work surface while providing a substantially planar surface for the shin to rest upon.

Figure 4G:
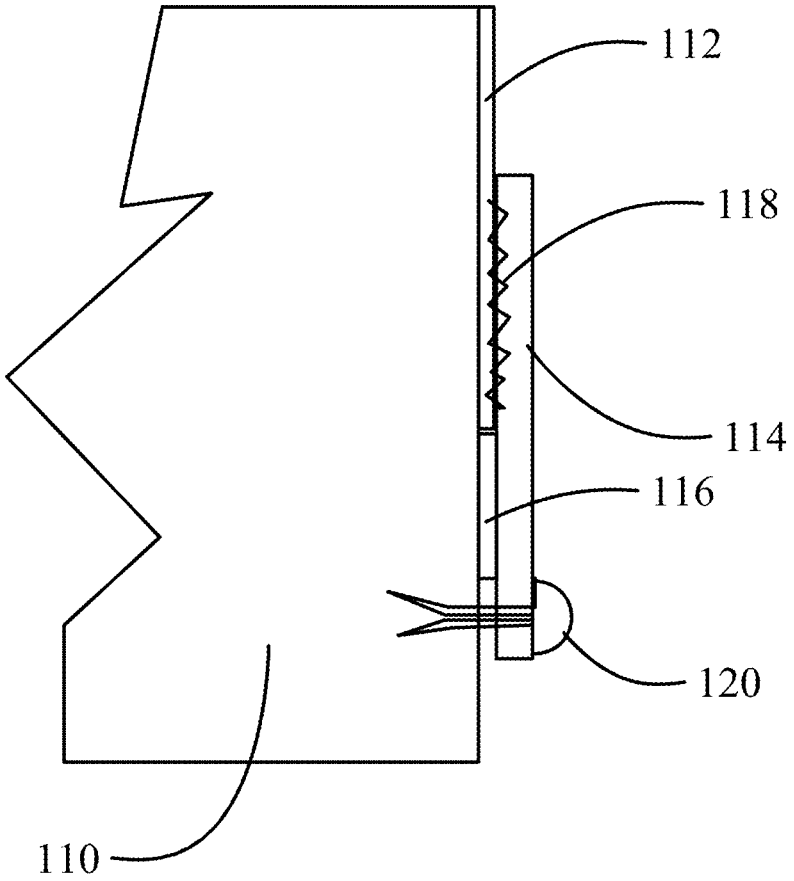
FIG. 4G is a side section view of a pad demonstrating attachment of the mating securing element to the pad; and, FIG. 5 is a flow chart of a method for implementing a system for rapid application and adjustment of protective cushioning employing the embodiments described.

Attachment of the mating securing strips to the pad may be accomplished using several options. A section of the pad 110 shown in FIG. 4G (with dimensions exaggerated for clarity) may be fabricated from a selected foam including styrofoam, polyurethane or polypropylene. The pad 110 may be covered with a fabric covering 112. Securing strip 114 may be affixed to the pad surface using an adhesive layer 116, sewn to the fabric covering with stitching 118 or mechanically fastened to the pad using expanding clips 120, rivets or similar fasteners which pierce the foam, or combinations of these methods.

For the embodiments shown, the securing means and mating securing means have employed hook and loop fasteners. In alternative embodiments snaps or similar releasable fasteners may be employed. Additionally, the surfaces and cavities displayed are rounded or cylindrical but may be rectangular or planar angle (V shaped) in alternative embodiments to substantially surround and engage the body part covered.

Figure 5:
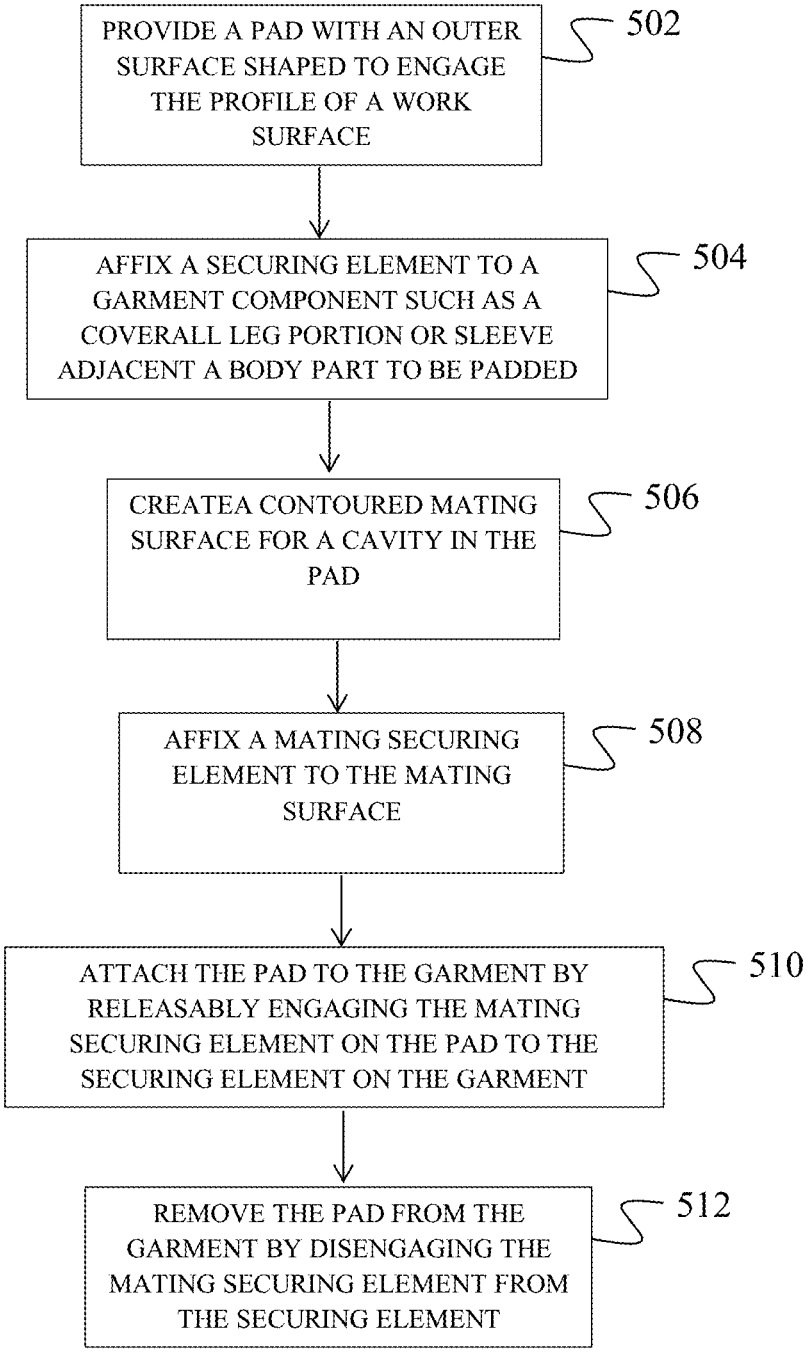

The embodiment described provide a method for operation of a system for rapid application and adjustment of protective cushioning as shown in FIG. 5. A pad is provided with an outer surface shaped to engage the profile of a work surface, step 502. A securing element is affixed to a garment component such as a coverall leg portion or sleeve adjacent a body part to be padded, step 504. A contoured mating surface may be created for a cavity in the pad, step 506, to enhance engagement of the body part and a mating securing element is affixed to the mating surface, step 508. The pad is attached to the garment by releasably engaging the mating securing element on the pad to the securing element on the garment, step 510. The pad may be removed from the garment by disengaging the mating securing element from the securing element, step 512.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A working system for aircraft mechanics, the system comprising:

a garment component comprising a leg or a sleeve of a garment having an inner surface contacting a body portion and having an outer surface with a securing element affixed thereto;

a pad set with two adjoining pads having mating securing elements affixed thereto, the mating securing element releasably attachable to the securing element to engage the pad set to the garment component to protect the body portion, the two adjoining pads further having an outer surface; and a work surface having a profile having dimples and spaced stringers;

wherein the outer surface has a contour with extensions configured to be received in the dimples of the profile of the work surface and joining contoured surfaces of the two adjoining pads have a mated contour configured to receive spaced stringers in the profile of the work surface and the pad maintains a planar surface for engaging the body portion with the outer surface engaging the work surface.

2. The working system as defined in claim 1 wherein the securing element and mating securing element are mating first and second hook and loop fastener strips.

3. The working system as defined in claim 2 wherein the first hook and loop fastener strip is affixed to the garment component with an adhesive.

4. The working system as defined in claim 2 wherein the second hook and loop fastener strip is affixed to the pad with an adhesive.

5. The working system as defined in claim 2 wherein the pad incorporates a fabric covering and the second hook and loop fastener strip is sewn to the fabric covering.

6. The working system as defined in claim 2 wherein the first hook and loop fastener strip is sewn to the garment component.

7. The working system as defined in claim 2 wherein the second hook and loop fastener strip is attached to the pad with a mechanical fastener.

8. The working system as defined in claim 1 wherein the garment component is a sleeve adapted to cover an arm.

9. The working system as defined in claim 1 wherein the garment component is a leg adapted to cover a shin.

10. The working system as defined in claim 1 wherein the pad incorporates a sculpted surface to engage the body portion.

11. The working system as defined in claim 1 wherein a first of the two pads includes a tab received in a relief in a second of the two pads to interengage the pads.

12. A method for operation of a system for rapid application and adjustment of protective cushioning comprising:

affixing a securing element to an outer surface of a garment component comprising a leg or sleeve of the garment having an inner surface adjacent a body part to be padded;

affixing a mating securing element to mating surfaces of a pad set with two adjoining pads;

releasably attaching the pad set to the garment component by engaging the mating securing element of two adjoining pads in the pad set to the securing element on the garment component; and engaging a profile of a work surface having dimples and spaced stringers within an outer surface profile of the pad wherein outer surface has a contour with extensions configured to be received in the dimples of the profile of the work surface and joining contoured surfaces of the two adjoining pads have a mated contour configured to receive spaced stringers in the profile of the work surface thereby providing a planar surface for engagement of the body portion.

13. The method for operation of a system for rapid application and adjustment of protective cushioning as defined in claim 12 further comprising creating a contoured mating surface for a cavity in the pad to enhance engagement of the body part.

14. The method for operation of a system for rapid application and adjustment of protective cushioning as defined in claim 12 wherein the securing element and mating securing element are hook and loop fastener strips and the steps of affixing the securing element and mating securing element comprise adhesively bonding the securing element fastener strip to the garment component and adhesively bonding the mating securing element fastener strip to the pad.

15. The method for operation of a system for rapid application and adjustment of protective cushioning as defined in claim 12 wherein the securing element and mating securing element are hook and loop fastener strips and the steps of affixing the securing element and mating securing element comprise sewing the securing element fastener strip to the garment component and sewing the mating securing element fastener strip to a fabric shell on the pad.

16. The method for operation of a system for rapid application and adjustment of protective cushioning as defined in claim 12 further comprising disengaging the securing element and mating securing element to remove the pad from the garment component.

17. A working system for aircraft mechanics, the system comprising:

a garment component comprising a leg or a sleeve of a garment having an inner surface contacting a body portion and having an outer surface with a securing element affixed thereto;

a pad set with two adjoining pads wherein a first of the two pads includes a tab received in a relief in a second of the two pads to interengage the two pads, said pad set having a mating securing elements affixed thereto, the mating securing elements releasably attachable to the securing element to engage the pad set to the garment component to protect the body portion, the pad set further having an outer surface; and a work surface having a profile having dimples and spaced stringers;

wherein the outer surface has a contour with extensions configured to be received in the dimples of the profile of the work surface and joining contoured surfaces of the two adjoining pads have a mated contour configured to receive spaced stringers in the profile of the work surface and the pad maintains a planar surface for engaging the body portion with the outer surface engaging the work surface.

18. The working system as defined in claim 17 wherein the securing element and mating securing elements are mating first and second hook and loop fastener strips, wherein the first hook and loop fastener strip is affixed to the garment component with an adhesive and wherein the second hook and loop fastener strip is affixed to the pad set with an adhesive.

19. The working system as defined in claim 17 wherein each of the two adjoining pads incorporates a fabric covering and the second hook and loop fastener strips are sewn to the fabric covering and wherein the first hook and loop fastener strip is sewn to the garment component.

20. The working system as defined in claim 17 wherein the garment component is a leg adapted to cover a shin.

* * * * *